United States Patent [19]

Hart

[11] Patent Number: 4,478,167

[45] Date of Patent: Oct. 23, 1984

[54] COUPLING SYSTEM FOR A MULTIPLE SECTIONED BOAT

[76] Inventor: Kevin G. Hart, 35 Ocean Ave., Harwich Port, Mass. 02646

[21] Appl. No.: 260,314

[22] Filed: May 4, 1981

[51] Int. Cl.[3] ..... B63B 7/04

[52] U.S. Cl. ..... 114/352

[58] Field of Search ..... 114/352, 353, 77 R, 114/77 A

[56] References Cited

U.S. PATENT DOCUMENTS

| | | | |
|---|---|---|---|
| 957,820 | 5/1910 | Vaniman | 114/352 |
| 1,148,961 | 8/1915 | Ellison | 114/352 |
| 3,121,238 | 2/1964 | Levinson | 114/353 |
| 3,266,067 | 8/1966 | Windle | 114/352 |
| 3,400,414 | 9/1968 | Windle | 114/352 |
| 3,744,071 | 7/1973 | Bossler | 114/352 |
| 3,996,634 | 12/1976 | Grind | 114/352 |
| 4,052,761 | 10/1977 | Rilling | 114/352 |
| 4,366,769 | 1/1983 | Lingeman | 114/352 |

FOREIGN PATENT DOCUMENTS

| | | | |
|---|---|---|---|
| 1128709 | 10/1968 | United Kingdom | 114/352 |
| 1416986 | 12/1975 | United Kingdom | 114/352 |

*Primary Examiner*—Sherman D. Basinger
*Assistant Examiner*—Stephen P. Avila

[57] ABSTRACT

A system for firmly fastening together two or more independently buoyant sections of a multiple sectioned boat along interfacing bulkheads above the waterline, and at least one matable fastener disposed near or below the waterline on each of the interfacing bulkheads. The lower fastener includes a projecting member mounted in a watertight manner through one interfacing bulkhead of a particular hull section and a correspondingly shaped socket disposed through the opposing adjacent bulkhead that receives the projecting member.

1 Claim, 7 Drawing Figures

COUPLING SYSTEM FOR A MULTIPLE SECTIONED BOAT

BACKGROUND OF THE INVENTION

This invention relates generally to a coupling system for multiple sectioned boats, and specifically to a matable connector system that firmly but effectively joins two adjacent independently buoyant boat sections together.

Sectional boats provide advantages with respect to compact stowage and ease of handling and transport, since the mass of the vessel is distributed over more than one unit. Multiple sectioned boats may perform the same functions as single hull vessels, and commonly range in size from 8 to 15 feet, though the use of this invention is not limited by length per se. The resulting craft or vessel comprised of joined together sections may be propelled by engine, sail, oars, or paddles, or any combination thereof. In a preferred embodiment, smaller buoyant sections should fit inside larger ones for compact stowage, though this feature is not necessarily a requirement of the invention.

The acceptance and employment of boats comprised of individual sections have been somewhat limited because of deficiencies in achieving safe and rigid coupling of the adjacent sections. Some of the deficiencies include specialized mechanical arrangements of excess weight, complexity, and manufacturing expense; cumbersome procedures for alignment and attachment of sections; inadequate structural integrity under stress-filled operating conditions; and lack of independent buoyancy or watertight integrity in one or more hull sections.

The present invention provides a unique coupling system which overcomes the above deficiencies.

SUMMARY OF THE INVENTION

A multiple sectioned vessel is comprised of individual sections, each of which is independently buoyant, joined together by one or more positive clamps disposed above the waterline between adjacent bulkheads and one or more rigid projecting members mounted at the lower area of one boat section near the waterline that engages a socket in the adjoining boat section, the socket itself being watertight relative to the hull section in which it is housed.

The coupling system, in accordance with the present invention, requires that each boat section has at least one bulkhead for joinder with a corresponding bulkhead in a different (adjoining) hull section, such bulkheads termed the "interfacing bulkheads". A particular hull segment may therefore have one or two interfacing bulkheads depending on the number of sections in the ultimate vessel employed.

In the preferred embodiment, each interfacing bulkhead will be configured to fit snugly and flushly in contact with an abutting, adjacent interfacing bulkhead.

The interfacing bulkhead of each boat section has two particular areas of concern, namely, the upper portion, above the waterline, and the lower portion, which will be near or below the waterline.

Above the waterline, the coupling system is comprised of one or more clamps, which may be comprised of threadable fasteners which pass through aligned apertures in each interfacing bulkhead so that a rotatable correspondingly matable threaded nut may be attached thereto. The bulkhead may include reinforcing metal plates surrounding the holes through the bulkhead for additional strength. In the preferred embodiment at least two threaded fasteners, spaced apart, are deployed laterally to alleviate stresses resulting from potential rotation of the hull sections relative to each other. Preferably they are disposed toward the lateral sides of interfacing bulkheads at their upper areas.

The other area of concern on interfacing bulkheads is the lower portion, which lies near or below the waterline. In this area, one or more rigid, rod-shaped, elongated members project from one bulkhead, each member mounted through the bulkhead in a watertight enclosure. The boat section to be joined has a watertight socket mounted through its bulkhead, firmly embedded in a rigid watertight casing attached securely to the bulkhead and the hull panel it adjoins, which receives the elongated member. In the preferred embodiment, each rigid member has a smooth exterior surface and may be tapered near its end to facilitate location and insertion into its corresponding socket. The connectors near the waterline require no manual intervention when connecting or disassembling the boat sections.

To assemble a typical sectional boat in accordance with the present invention, the operator aligns the interfacing bulkheads between each boat section so that the rigid elongated members near the waterline also align with the corresponding sockets in the adjacent section to be joined, as do the fastener holes above the waterline. After alignment is accomplished, the boat sections are pushed or pulled together (flush), such that the elongated members are inserted into the sockets. The threaded fasteners are then disposed through the appropriate aligned apertures and the nuts manually tightened.

It is an object of this invention to provide an improved coupling system for joining together two or more independent buoyant sections to form a larger buoyant vessel.

It is a further object of this invention to provide a sectional boat hull coupling system that is relatively inexpensive to manufacture, that is easily employable, eliminating cumbersome procedures of alignment, and one that forms an extremely strong coupling, insuring structural integrity between adjacent hull sections and insuring watertight integrity in each section.

In accordance with these and other objects which will be apparent hereinafter, the instant invention will now be described with particular reference to the accompanying drawings.

THE PREFERRED EMBODIMENT OF THE INVENTION

Figure 1:
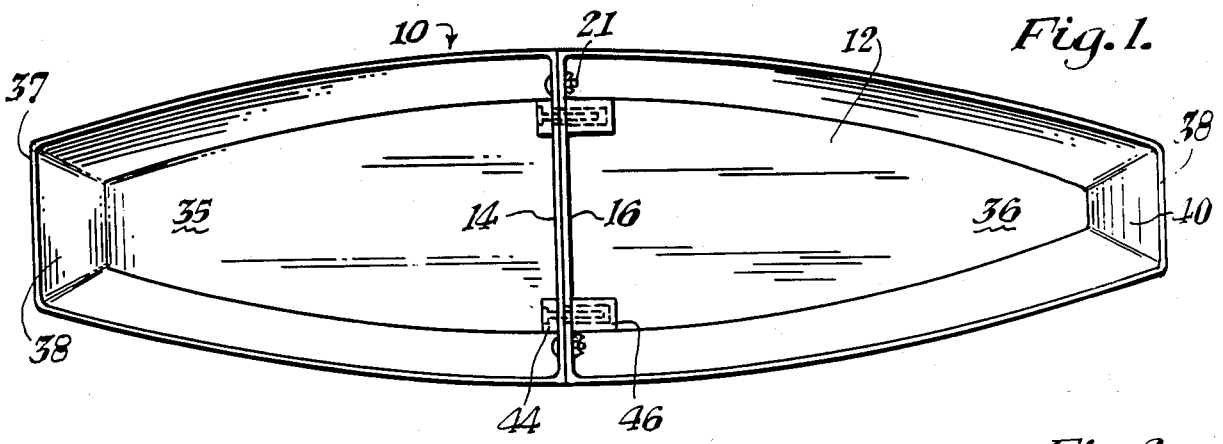
FIG. 1 shows a top plan view of a pair of hull sections joined together in accordance with the preferred embodiment of the invention.
Figure 2:
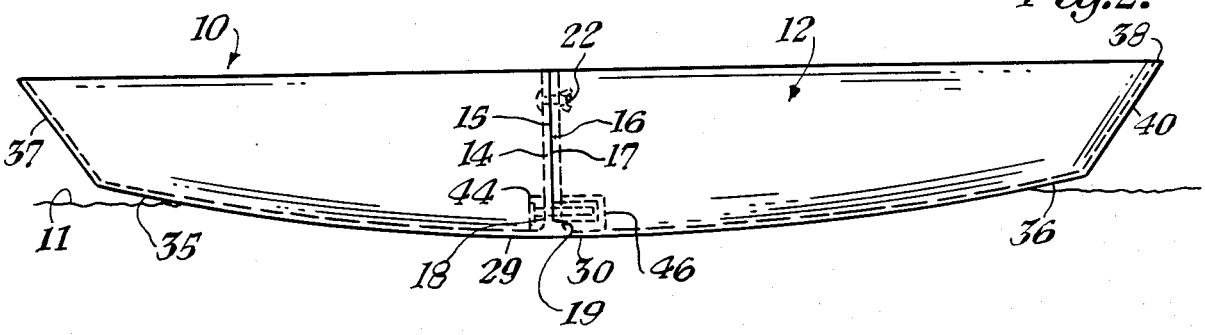
FIG. 2 shows a side elevational view of the present invention.

Referring now to the drawings, and specifically to FIGS. 1 and 2, the invention is shown coupling together buoyant hull sections 10 and 12, which themselves may be constructed from a wide variety of materials, conventional in the boat building industry. Bulkheads 14 and 16 interface, joining sections 10 and 12 together. Bulkhead 14 includes the exterior bulkhead surface area 15, while bulkhead 16 includes exterior surface area 17, the surfaces of 15 and 17 joined together in flush, engaging contact whenever the hull sections 10 and 12 are joined together in accordance with the invention.

Hull sections 10 and 12 are attached above the waterline by one or more threaded fasteners such as a bolt 21 and a wing nut 22 which pass through apertures in each bulkhead that are aligned between the hull sections at desired locations.

Figure 3:
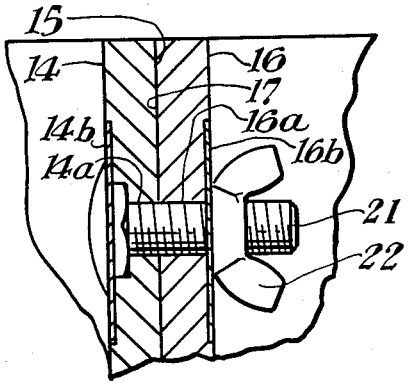
FIG. 3 shows an enlarged, fragmentary, side elevational view of the fastener used above the waterline with the preferred embodiment of the present invention.

As shown in FIG. 3 the threaded fastener includes a bolt 21 having appropriate threads that passes through apertures 14*a* in bulkhead 14 and aperture 16*a* in hull 16. The threaded fastener 21 has a wing nut 22 mounted thereon which is tightened to form the upper positive clamp to hold the hull sections firmly together. For added rigidity, a reinforcing plate 14*b* may be mounted on bulkhead 14 and reinforcing plate 16*b* may be mounted on bulkhead 16. The reinforcing plates 14*b* and 16*b* may be made of metal and recessed into the surface.

Figure 4:
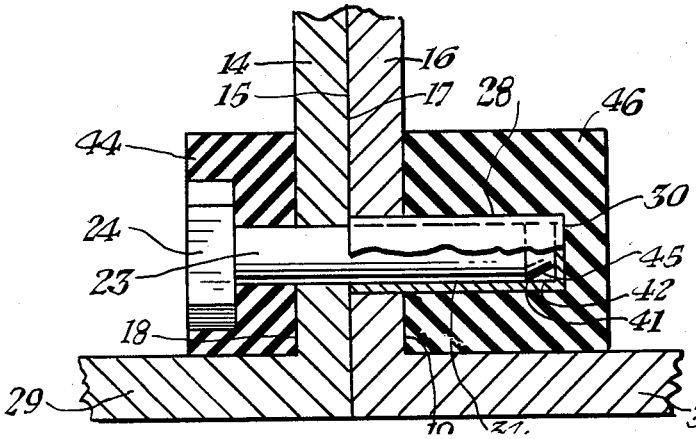
FIG. 4 shows an enlarged, fragmentary, side elevational view (partially in cross-section) showing the lower coupling member used below the waterline with the present invention.

FIGS. 2 and 4 show the coupling system employed in the area of waterline 11, comprising one or more rigid elongated members 23 having a head 24 that is firmly affixed to watertight casing 44, which is rigidly attached to bulkhead 14 and hull section 29 and projects through interfacing bulkhead 14, and one or more watertight sockets 28 firmly embedded in watertight casing 46 and rigidly attached to hull section 30 and bulkhead 16 through said bulkhead. The elongated rigid member and a corresponding socket are positioned in such a way relative to the respective bulkheads and hull sections in each section of the vessel that the watertight integrity of each boat section is maintained. When a boat section having a socket is launched, the socket may fill with water, but water will not enter the hull since the exterior wall of the socket is a watertight barrier relative to the interior of the boat section. The elongated projecting member may be fabricated from metal, wood, fiberglass, or other rigid materials which can be shaped to a rod-like form. Each member is sized appropriately to resist effectively the forces generated by the mass and function of the vessel. Socket 27 may also be made from metal, wood, fiberglass, or other suitable materials which may be contoured in size and shape to readily yet snugly accept the insertion of the respective projecting member, while allowing displacement of water which may enter the socket. The projecting members (and the socket used therewith) must be of sufficient strength to sustain the forces on the hull sections, with minimal space therebetween sufficiently small to resist deflection induced when upward-acting forces are applied to the extremities of the assembled boat 30 and 32.

Flection of hull sections 10 and 12 relative to one another is resisted by engagement of the elongated projecting members at their extremities with the interior surface of their respective sockets. As the ends of boat sections 30 and 32 are raised, the lower exterior surface of the projecting member at its extreme interior point of insertion 41 engages the interior lower surface of its socket 42, while the upper surface of the projecting member at its point of entry into the socket 43 engages the upper interior surface of the socket at its open end.

Flection is further resisted by the positive attachment of the threaded fasteners above the waterline. The positive clamping forces generated by these devices are transmitted to the lower areas of interfaced hull sections 18 and 19 through the rigidly constructed bulkheads 14 and 16 which they join together.

The alignment of hull sections 10 and 12 and insertion of the projecting members 23 prior to positive attachment of sections 10 and 12 may be facilitated when projecting members are tapered toward their exterior tips 45. Corresponding sockets 27 may be shaped to accommodate the tapering. The length which said members protrude from their respective hull sections may be varied, the longest member first being partially inserted into its socket, insertion of other projecting members following in sequence according to diminishing length as alignment proceeds.

Figure 5A:
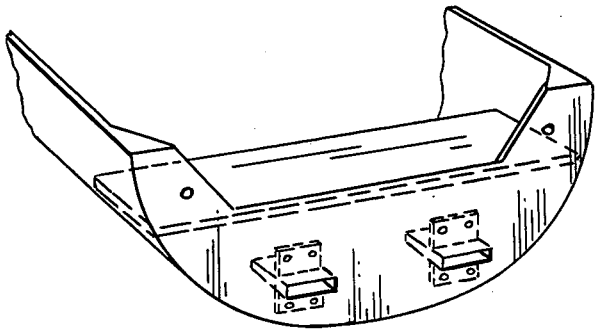
FIGS. 5*a* and 5*b* show alternate embodiments of the present invention.
Figure 5B:
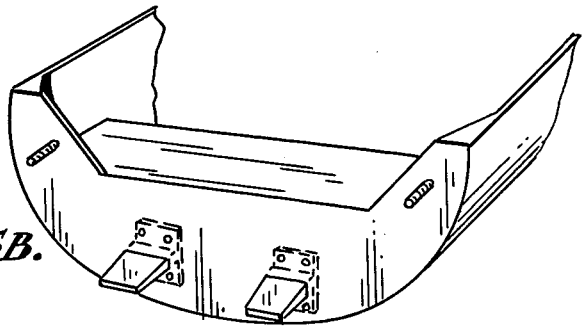

FIGS. 5*a* and 5*b* show an alternate embodiment of the invention in which the rod-like projecting members are replaced by rigid flat plates mounted from one bulkhead that are received into correspondingly shaped watertight sockets mounted through the corresponding opposite bulkhead.

Figure 6:
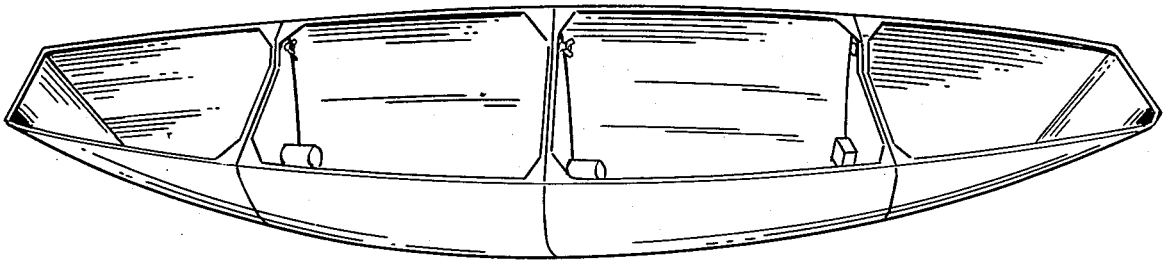
FIG. 6 shows a multi-sectional boat constructed with the coupling system disclosed herein.

FIG. 6 shows a vessel having multiple sections (four) employing the present invention.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A system for joining together at least two independently buoyant boat hull sections to form a singular vessel, said first and second boat hull sections each having a hull panel and an interface bulkhead which flushly mates with a corresponding interface bulkhead in an adjacent hull section to be attached, the system for joining said boat hull sections comprising:

at least one threaded fastening means which is mountable through the upper areas of said first and second interface bulkheads for positive clamping together of said first and second bulkheads above the waterline, said first and second interface bulkheads having alignable passages which are coaxial when the first and second hull sections are joined and receive the fastening means;

at least one rigid elongated pin which resists flection along the interface, said rigid elongated pin being anchored near the waterline, and being mounted through said first bulkhead and embedded in a rigid watertight block firmly and directly attached to the bulkhead and the hull panel it adjoins; said second bulkhead having a watertight recessed socket with a closed end securely embedded in a rigid watertight casing, said socket firmly and directly fastened to the bulkhead it adjoins, and said casing being firmly and directly fastened to the bulkhead and the hull panel it adjoins; said socket being dimensioned to correspondingly engage in a ready and snug manner and said elongated pin.

* * * * *